US005134835A

United States Patent [19]

Walkiewicz, Jr. et al.

[11] Patent Number: 5,134,835

[45] Date of Patent: Aug. 4, 1992

[54] FILM WRAPPING APPARATUS

[75] Inventors: Zigmunt J. Walkiewicz, Jr., Chagrin Falls; David W. O'Brien, North Ridgeville, both of Ohio

[73] Assignee: Clamco Corporation, Cleveland, Ohio

[21] Appl. No.: 787,009

[22] Filed: Nov. 4, 1991

[51] Int. Cl.[5] ..... B65B 41/16; B65B 9/08

[52] U.S. Cl. ..... 53/568; 53/229; 53/389.4

[58] Field of Search ..... 53/389.4, 389.2, 389.5, 53/229, 562, 550, 568, 389.3

[56] References Cited

U.S. PATENT DOCUMENTS

| | | | |
|---|---|---|---|
| 2,894,363 | 7/1959 | Voogd | 53/389.2 X |
| 3,045,403 | 7/1962 | Mitchell | 53/568 X |
| 3,067,553 | 12/1962 | Rivman et al. | 53/568 X |
| 3,161,002 | 12/1964 | Duns | 53/389.4 X |
| 3,195,289 | 7/1965 | Cochrane | 53/568 |
| 4,691,503 | 9/1987 | Frerich | 53/389.3 X |
| 4,774,796 | 10/1988 | Aiuola et al. | 53/389.5 X |
| 4,811,544 | 3/1989 | Cinotti | 53/389.5 X |
| 4,825,622 | 5/1989 | Nigg | 53/389.5 X |
| 4,956,960 | 9/1990 | Anstey et al. | 53/389.2 X |

*Primary Examiner*—Horace M. Culver

*Attorney, Agent, or Firm*—Tarolli, Sundheim & Covell

[57] ABSTRACT

A film wrapping apparatus is presented herein wherein a support structure supports a work surface at which items are wrapped in film. A drawer assembly is carried by the support structure below the work surface and includes a drawer carried by the support structure for slidable horizontal movement between a drawer pulled out position and a drawer pushed in position. A pair of cradle rollers are carried by the drawer and support a roll of film as the roll rotates about its axis as film is pulled from the roll. A film gripper grips the leading edge of the film and pulls the film from the roll as the gripper is displaced from a first position below the work surface to a second position proximate to the work surface. The film gripper is actuated so as to move from the first position to the second position as the drawer is moved toward its pushed in retracted position.

10 Claims, 6 Drawing Sheets

CONTROL
MOTOR CONTROL

Fig.6
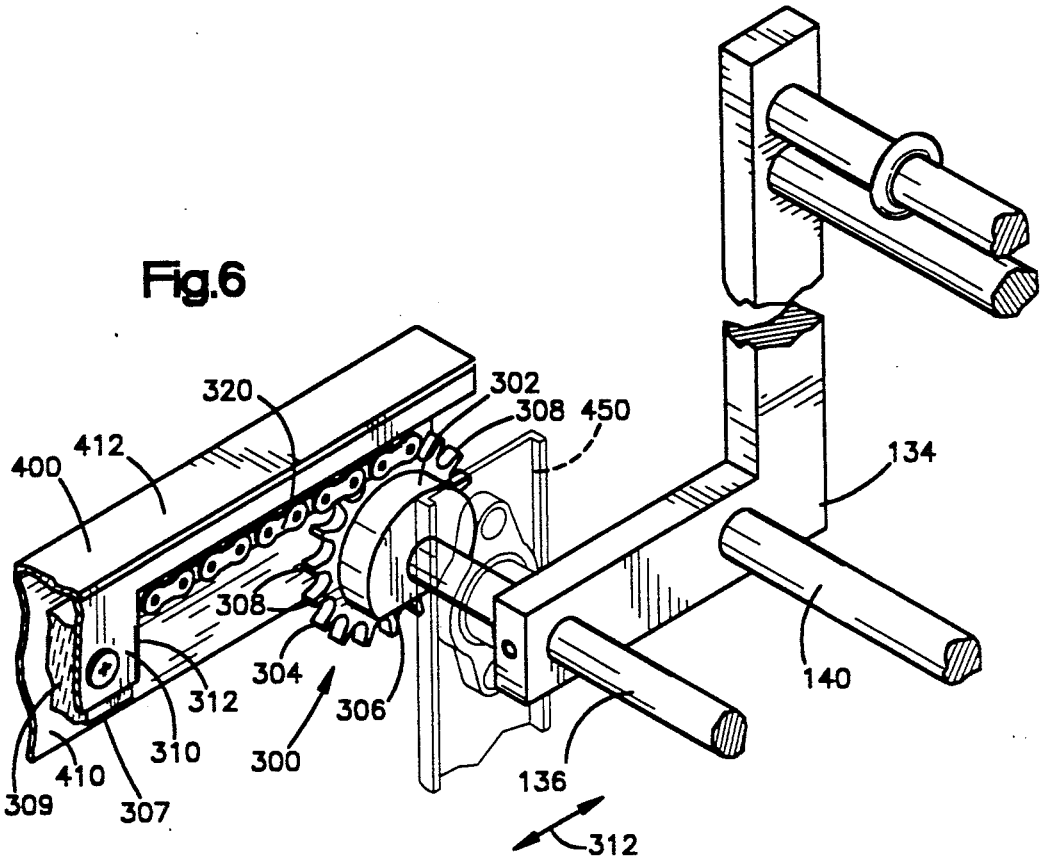
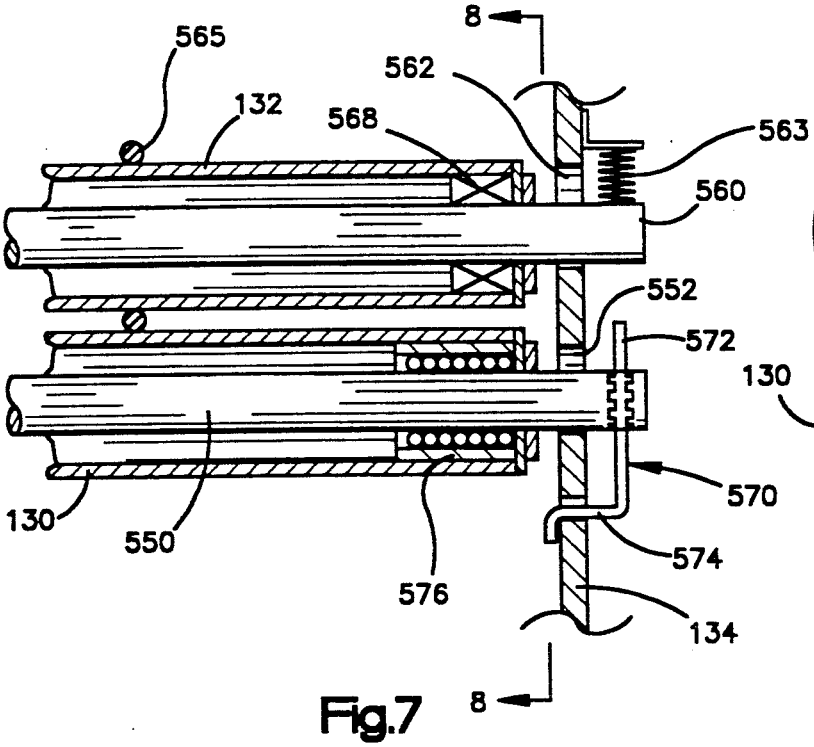
Fig.7
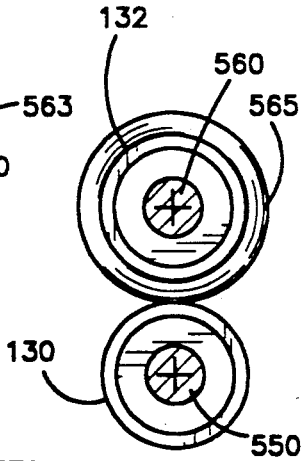
Fig.8

FILM WRAPPING APPARATUS

BACKGROUND OF THE INVENTION

This invention relates to the art of film wrapping apparatus for use in wrapping objects with thermoplastic film, such as polyvinyl chloride wrapping film, and more particularly to improvements directed to dispensing film from a film roll.

It is known in the art to provide film wrapping apparatus which includes a support structure having an upper work surface at which items are to be wrapped in film with the film then being sealed and severed to complete a film enclosure around the item. An example of such a wrapping machine is provided by the Clamco Corporation and known as the Model 6500 machine. This is an automatic machine that employs a conveyor that receives items to be wrapped in film and a film wrapping device that encloses each item with film which is then severed and sealed about the item. The film is supplied to the wrapping apparatus from a film roll that is supported by a pair of cradle rollers located above the work surface. The film is pulled from the roll as it rotates about its axis of rotation. The film is pulled by means of a pair of pinch rollers of which one is driven by a motor with the film being guided past rollers in a downward direction to the work surface where the film is wrapped about an article.

One problem presented is the difficulty for an operator to position a roll of film, which may weigh on the order of 90 pounds, onto the cradle rollers located above the working surface and then thread the leading edge of the film through the pinch rollers and other guide rollers, all located above the work surface. It would be more desirable if the roll of film could be supported by cradle rollers located underneath the work surface and carried by a slidable drawer so that the drawer could be pulled out from the support structure of the film wrapping apparatus permitting the operator to load the film roll on the cradle rollers and then push the drawer back into its retracted position. It would be further desirable to provide some means for gripping the leading edge of the film so that as the film is pulled from the roll it is brought upward from a position below the working surface to a position essentially at or above the working surface. This would permit the operator to easily complete the threading of the film prior to commencing operation of the film wrapping apparatus.

There are examples in the prior art of film wrapping apparatus wherein a roll of film is mounted below the work surface at which the film wrapping takes place. Such examples include the machines disclosed in the U.S. Pat. Nos. to I. Feldman 3,800,499, D. B. Yeager 4,649,693, D. J. Rosenthal 3,595,456 and R. J. Skalsky et al. 4,936,079.

While each of these patents discloses a machine having cradle rollers or the like located below the work surface for supporting a roll of film, none of the patents teach the additional features of mounting the cradle rollers on a drawer which may be pulled out from the machine to enable an operator to load a roll of film on cradle rollers together with some means for gripping the leading edge of the film for withdrawing film from the roll, as the drawer is being closed, and then presenting the leading edge of the film to a position proximate the work surface to assist an operator in completing the threading of the film wrapping machine.

SUMMARY OF THE INVENTION

In accordance with one aspect of the present invention, a film wrapping apparatus is provided which includes a work surface at which items may be wrapped in film and a support structure that supports the work surface. A slidable drawer assembly is carried by the support structure below the work surface and this assembly includes a drawer which is mounted for slidable horizontal movement between a drawer pulled out extended position and a drawer pushed in retracted position. A pair of cradle rollers are carried by the drawer for supporting a roll of film as the roll rotates about its axis of rotation a film is being pulled from the roll. The leading edge of the film is gripped by a film gripper which pulls the film from the roll as the gripper is displaced from a first position located below the work surface to a second position proximate to the work surface. The gripper is actuated so as to move from the first position to the second position as the drawer is moved toward its pushed in retracted position.

BRIEF DESCRIPTION OF THE DRAWINGS

The foregoing and other objects and advantages of the invention will become more readily apparent from the following description of the preferred embodiment of the invention as taken in conjunction with the accompanying drawings which are a part hereof and wherein:

FIG. 6 is an enlarged fragmentary perspective view illustrating a gear and gear track;

FIG. 7 is an enlarged sectional view with part broken away illustrating the pinch rollers in greater detail; and FIG. 8 is a view taken along line 8-8 looking in the direction of the arrows in FIG. 7.

DESCRIPTION OF THE PREFERRED EMBODIMENT

Figure 1:
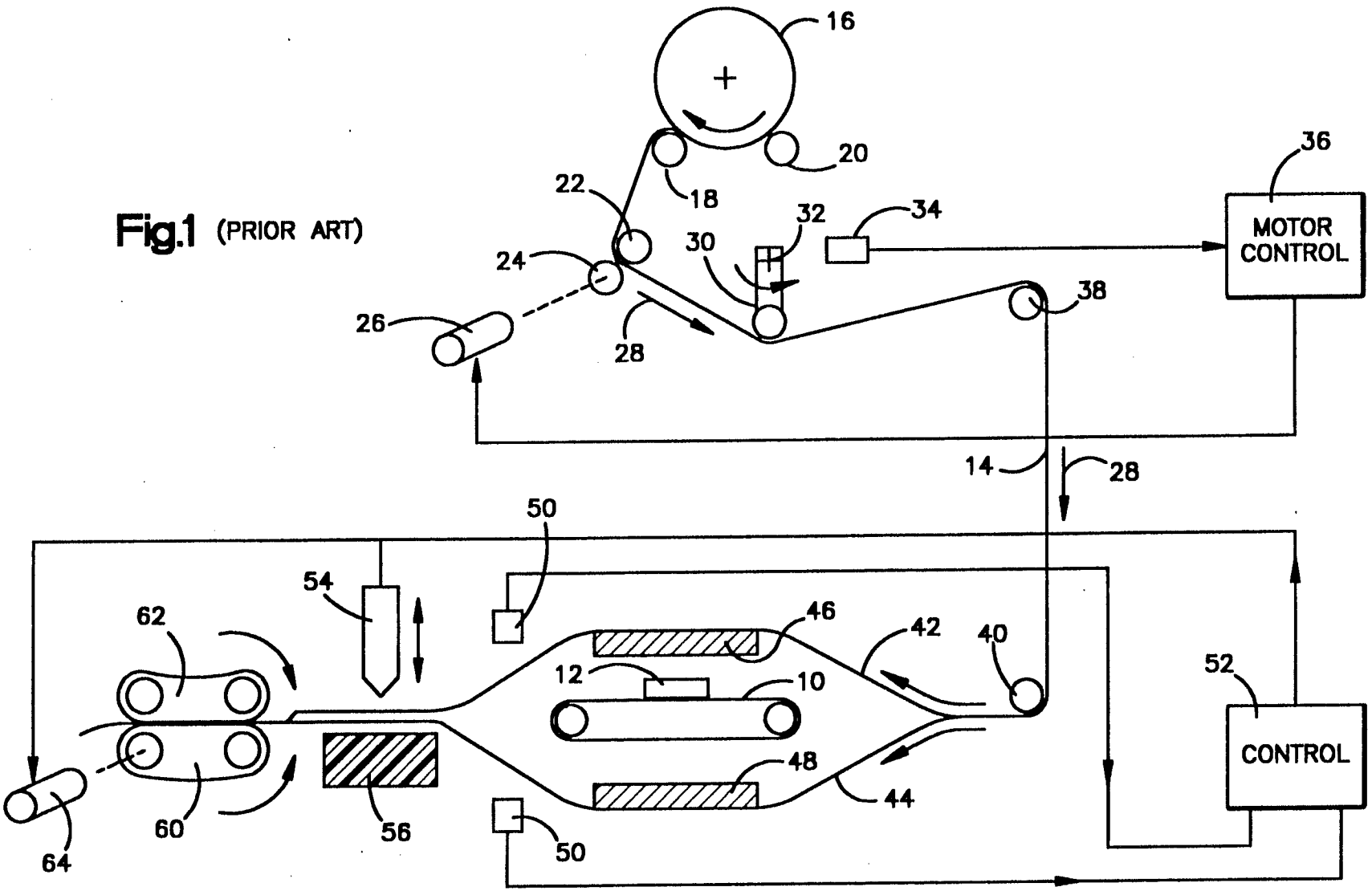
Fig.1 (PRIOR ART)
FIG. 1 is a schematic side elevational view illustrating a film wrapping apparatus constructed in accordance with the prior art.

Reference is now made to the drawings wherein the showings are for purposes of illustrating a preferred embodiment of the invention only and not for purposes of limiting same. The film wrapping apparatus of the prior art is schematically presented in FIG. 1. This represents the Clamco Corporation Model 6500 wrapping machine discussed hereinbefore. That machine has a work area at which a conveyor 10 is located. The conveyor includes a work surface on which items 12 are located to be wrapped in thermoplastic film. In this machine, the film 14 is withdrawn from a film roll 16 carried by a pair of cradle rollers 18 and 20 which are located above the work surface of the conveyor 10.

The cradle rollers 18 and 20 support the film roll 16 as the film roll rotates about its axis of rotation as film is being pulled from the roll. The film extends beyond cradle roller 18 and, thence, through a pair of pinch rollers 22 and 24. Pinch roller 24 is a driven roller in that it is intermittently driven by a motor 26 so that the pinch rollers pull the film from the film roll 16 with the film travelling a path in accordance with the arrow 28. The film is then webbed past a conventional dancer roller 30 which is pivotally mounted at a pivot point 32. Roller 30 is pivotally displaced to actuate a suitable switch 34 whenever film is to be withdrawn from the film roll 16. The switch 34, when actuated by the dancer roll 30, applies a signal to a motor control 36 which, in a conventional manner, turns on the motor 26 to rotate the pinch roller 24 to cause film to be withdrawn from the film roll for a controlled period of time. After the film passes the dancer roller 30, it is webbed over a roller 38 and then directed downwardly and around a vertically adjustable roller 40.

The thermoplastic film 14 is folded along a longitudinal center line and is known as center folded film. The film passes the roller 40 and is split apart into upper and lower film layers 42 and 44 as the film passes over upper and lower film inverting plates 46 and 48. Although not illustrated in the drawings, these inverting plates 46 and 48 also cause the film to invert and make a right angle turn as the film layers pass over and below the conveyor 10. As the film passes beyond the conveyor with products, such as item 12, having film wrapped thereon, this is detected by suitable detectors, such as photocells 50. This is sensed by a control circuit 52 which then actuates a suitable prior art sealing knife 54 to move downwardly to the film, which is supported by a rubber sealing pad 56, where the film is sealed and severed. Preferably an L sealer is employed in which the open side of the upper and lower films 42 and 44 is sealed with a longitudinally extending seal arm, while another transversely extending sealing knife 54 performs both a sealing and severing operation, all known and conventional in the prior art. The transversely extending sealing knife 54 is electrically heated sufficient to provide a sealing action for the film layers, together with a severing action. When the controller 52 activates the sealing knife 54, it also activates a pair of film advance belts 60 and 62 by energizing a motor 64 which drives belt 60 in a known manner.

The prior art wrapping machine of FIG. 1 requires that an operator place the film roll 16 on a pair of cradle rollers 18 and 20 located above the working area of the film wrapping machine. As such film rolls may weigh on the order of 60 to 90 pounds, it may be a difficult task for the operator. Moreover, the wrapping machine of FIG. 1 requires that the intermittently driven roller 24 be speed synchronized to that of the film advance belt 60 to maintain proper tension on the film 14. If the tension is improper, the film 14 will become overly stressed and will stretch. It has been found that such damaged film will not seal correctly.

Figure 2:
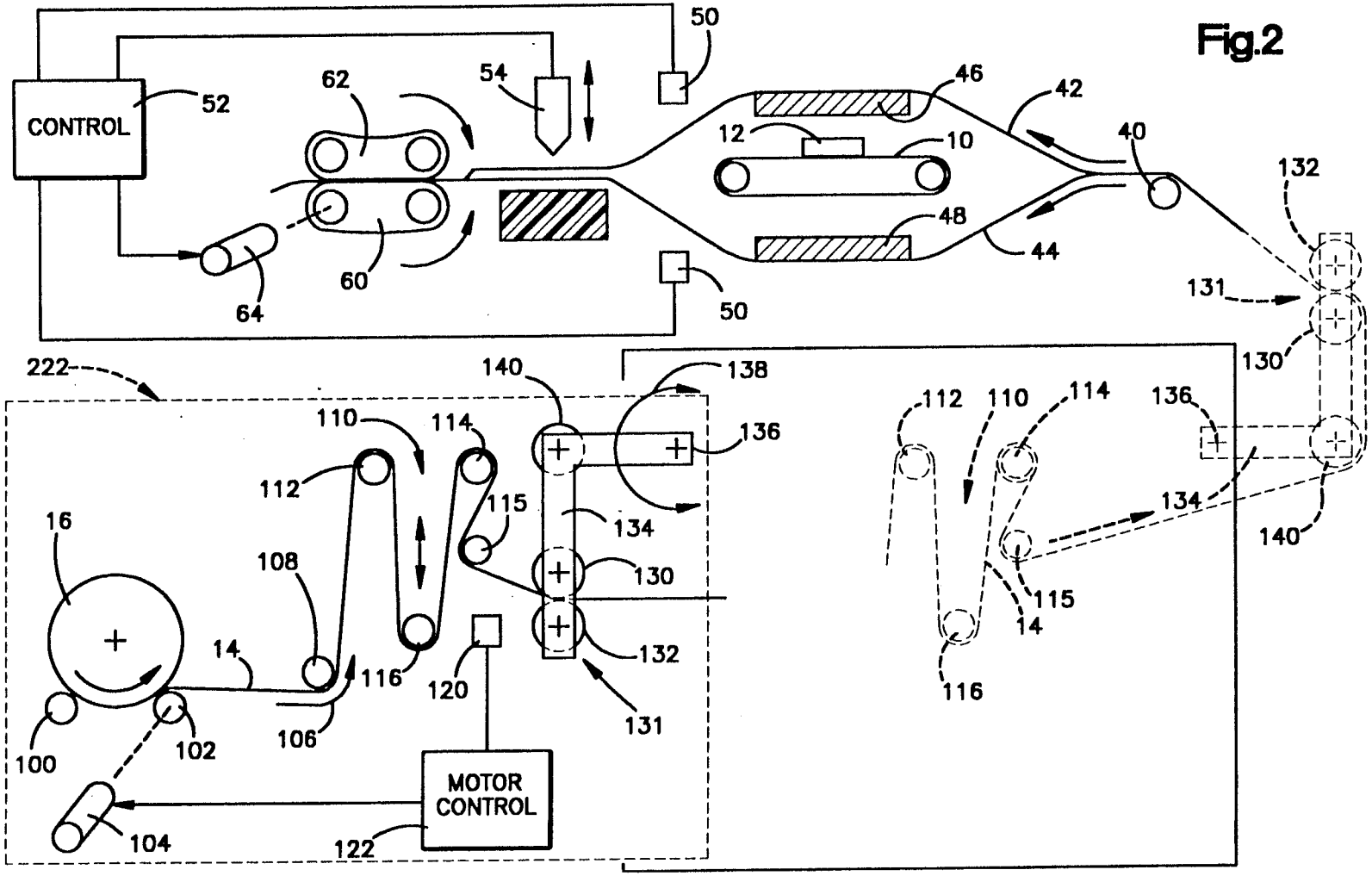
FIG. 2 is a schematic side elevational view of a film wrapping apparatus constructed in accordance with the present invention.

The above-noted difficulties with the film wrapping apparatus of FIG. 1 are obviated by employing a film wrapping apparatus in accordance with the present invention as depicted in the schematic illustration of FIG. 2. In the description that follows, the elements that are common in FIGS. 1 and 2 will be identified with like character references. In the embodiment of the invention of FIG. 2, the film roll 16 is rotatably supported by a pair of cradle rollers 100 and 102. As will be discussed hereinafter, cradle roller 102 is intermittently driven by a motor 104 so as to pull film 14 from the film roll 16 with the film movement being in the direction as indicated by the arrows 106. The film is then threaded past the roller 108 to a festoon 110 which includes a pair of stationary rollers 112 and 114 together with a vertically reciprocal dancer roller 116 with the film being threaded past these rollers as shown in FIG. 2. Such a festoon is known in the art and whenever the dancer roller 116 moves vertically upwardly form the position as shown in FIG. 2, it actuates a suitable proximity switch, such as switch 120. This is sensed by a motor controller 122 that recognizes this condition as a call for additional film. The motor controller activates the motor 104 to drive the cradle roller 102 so that film is withdrawn from the film roll 16 until the dancer roller 116 again moves vertically downward to the position as shown in FIG. 2 and the motor 104 is deenergized.

The film 14 exits from the festoon 110 by way of a roller 115 and is threaded between a pair of pinch rollers 130 and 132 journalled between a pair of swing arms 134 (only one of which is seen in FIG. 2). The pinch rollers 130 and 132 comprise a film gripper 131. Each swing arm 134, as will be described in greater detail hereinafter, is pivotally mounted to a drawer at a pivot point 136 so that the swing arm may be pivoted about the pivot axis 136 in the directions of the arrows 138. Each swing arm 134 is an L-shaped arm. An idler roller 140 is journalled between the elbows of the L-shaped swing arms 134. All of the parts that have been described hereinabove with reference to FIG. 2 are carried by a horizontally slidable drawer located below the film wrapping work area. The drawer is carried by a suitable support structure permitting slidable horizontal movement between a drawer pulled out fully extended position, as indicated by the solid lines of the festoon 110 in FIG. 2, and a drawer pushed in retracted position, as indicated by the dotted lines of the festoon 110 in FIG. 2. When the drawer is pushed into the support structure, the swing arm 134 is actuated so as to move from the position as shown in the solid lines to the position as shown by the dotted lines in FIG. 2 where the film 14 is brought up behind the film wrapping machine and then upward to a location proximate to the work are by the film gripper 131. The film gripper 131 presents the leading edge of film 14 to the operator who may then pull the leading edge from the pinch rollers 130 and 132 and thread the film over a roller 40 and thence over and under the film inverter plates 46 and 48 to the film severing an sealing area and then to the film advance belts 60 and 62.

The film gripper 131, which includes pinch rollers 130 and 132 grips the leading edge of the film and pulls the film from the film roll 16 as the film gripper is displaced by the L-shaped arms 134 from the position as shown in the solid lines in FIG. 2 to that as shown by the dotted lines in FIG. 2. To assist in this operation, roller 130 incorporates a one-way clutch permitting free movement of the roller in a direction for film advancement, counterclockwise rotation of roller 130 in FIG. 2, but restricting movement in the opposite direction. Consequently, this permits the rollers 130 and 132 to grip the leading edge of the film and exert pulling forces to pull the film from the roll 16 as the L-shaped swing arms 134 are pivoted in a counterclockwise direction about pivot point 136, as viewed in FIG. 2. The foregoing will become more apparent from the detailed description that follows relative to FIGS. 3–8.

Figure 3:
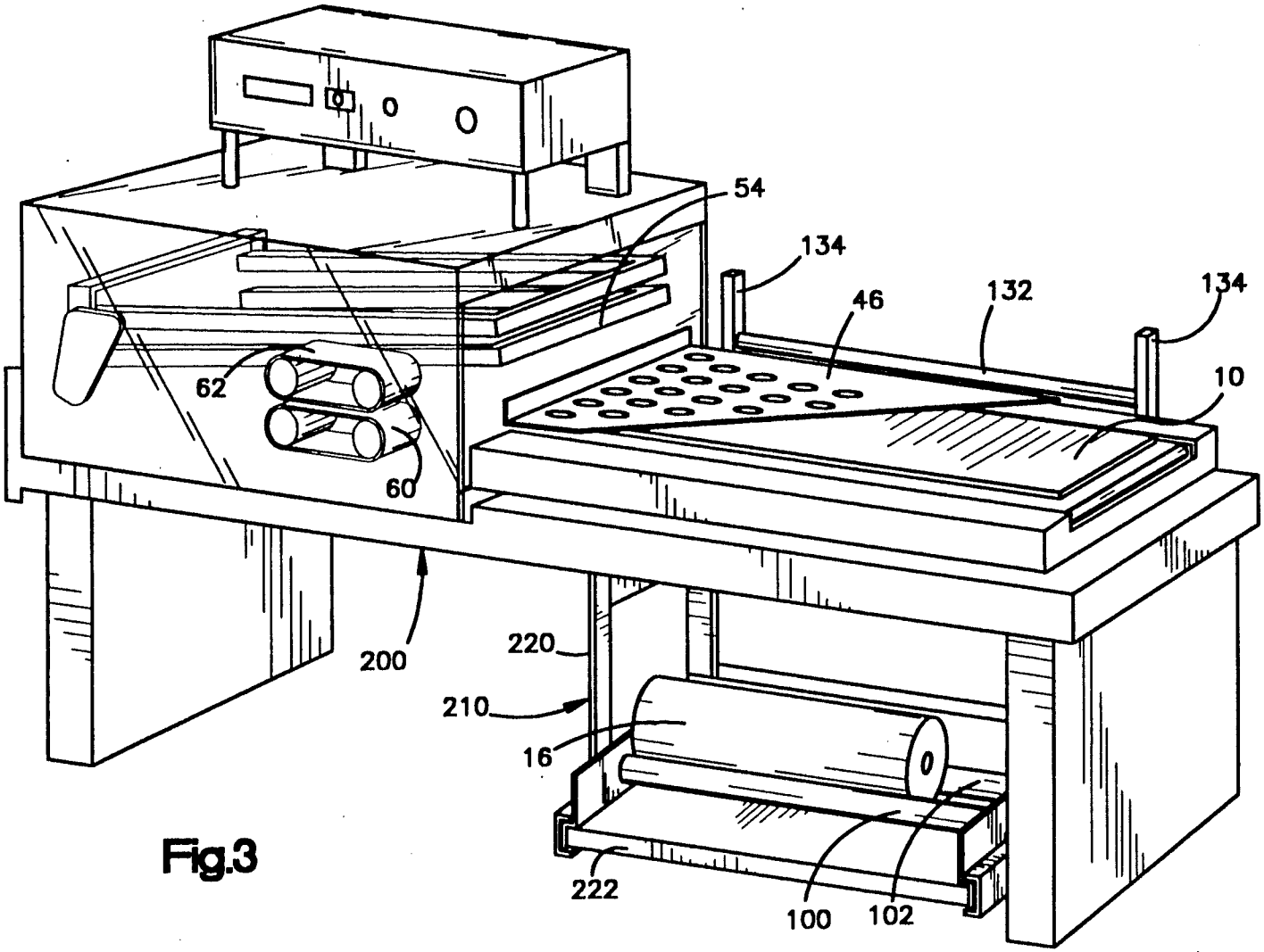
FIG. 3 is a perspective view of a film wrapping apparatus in accordance with one embodiment of the present invention.
Figure 4:
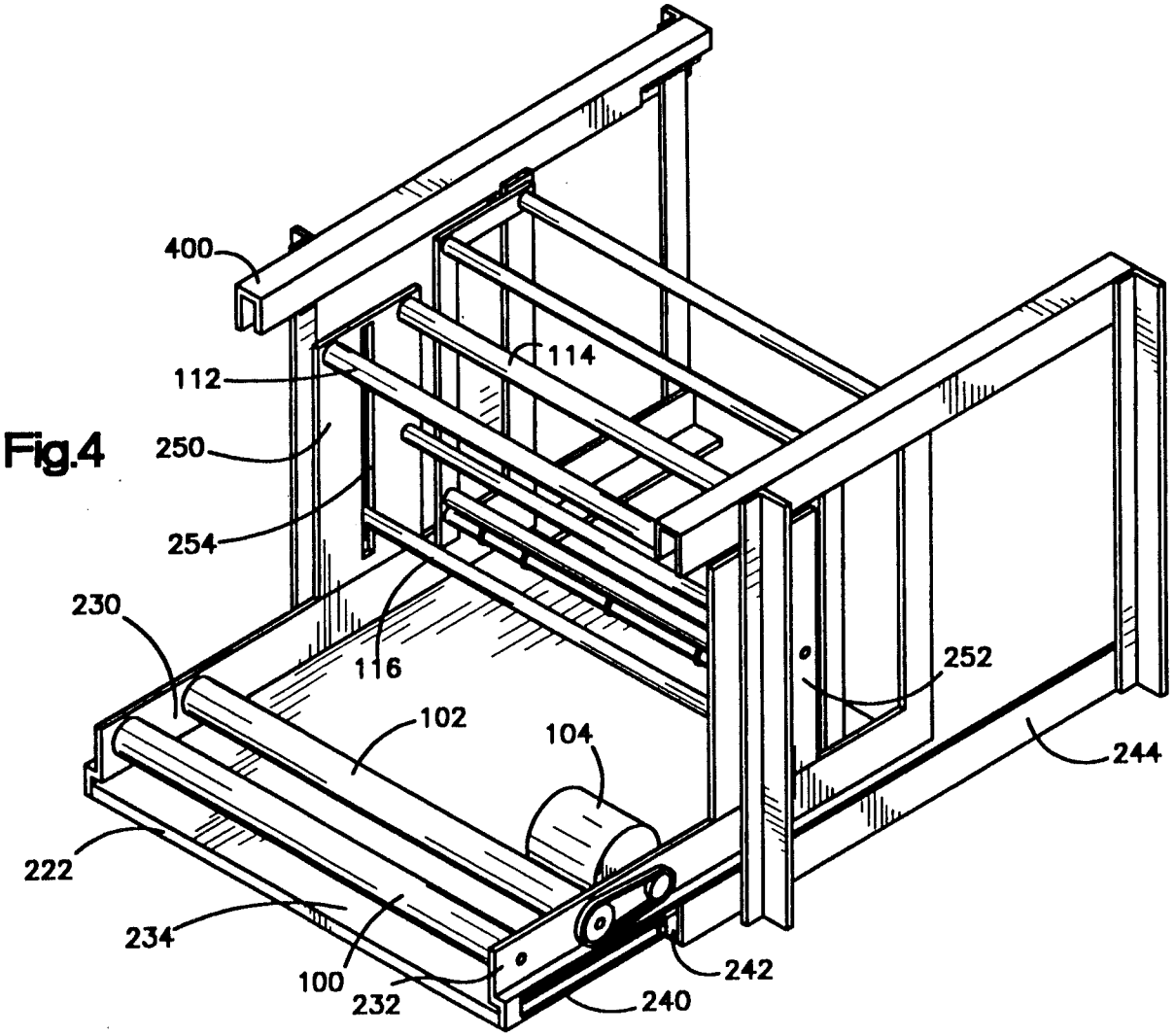
FIG. 4 is a perspective view illustrating the slidable drawer assembly with the drawer located in its pulled out extended position.
Figure 5:
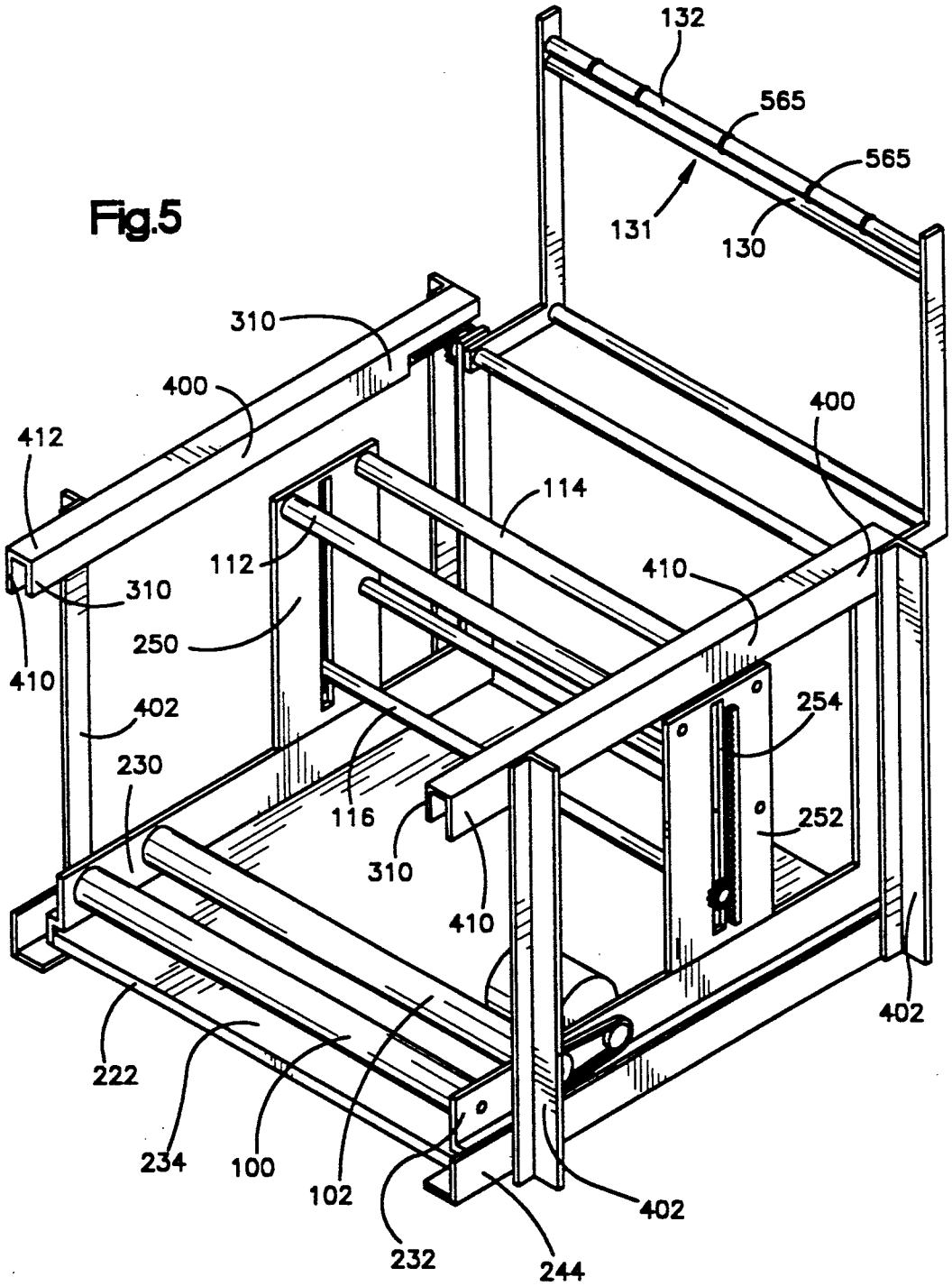
FIG. 5 is a view similar to that of FIG. 4 but showing the drawer in its pushed in retracted position.

Having briefly described the invention relative to the schematic illustration of FIG. 2, attention is now directed to FIGS. 3–8 wherein the film wrapping apparatus includes a support structure 200 which supports the elements located at the film wrapping station including the upper inverting plate 46 as well as the elements located at the sealing station, including the transversely aligned heat sealing knife 54, and the film advance belts 60 and 62 which grip one longitudinally extending edge of the film for pulling the film from the wrapping area. The drawer assembly 210 is carried by the support structure 200 and is located underneath the work surface defined by the upper surface of the conveyor 10. The drawer assembly 210 includes a stationary drawer frame structure 220 which carries a drawer 222. The drawer 222 is slidably mounted to the frame structure 220 for slidable horizontal movement between a drawer pulled out extended position (as is best seen in FIG. 4) and a drawer pushed in retracted position (as is seen in FIGS. 3 and 5).

The cradle rollers 100 and 102 extend transversely between and are suitably journalled in a pair of parallel extending side walls 230 and 232 which extend vertically upward by from the floor 234 of the drawer 222. Each of the drawer side walls 230 and 232 carries a slide, such as slide 240 shown in FIG. 4, and which is received by a cooperating track 242 mounted on a stationary member 244 and which member constitutes a portion of the frame structure 220. The track 242 is C-shaped in cross section providing a channel for slidably receiving the slide 240 as the drawer 222 is displaced in a horizontal direction.

The festoon 110 includes rollers 112, 114 and 115 and a vertically movable dancer roller 116 which rollers are journalled between upstanding supports 250 and 252 respectively carried by and mounted to the upstanding drawer side walls 230 and 232. Each of the supports 250 and 252 has a vertically extending slot, such as slot 254 in support 252, for slidably receiving the dancer roller 116 as it moves up and down during the operation. These vertical slots are aligned so that the dancer roll extends transversely between the supports.

The film gripper 131 serves to grip the leading edge of the film 14 and pull the film from the film roll 16 as the film gripper is displaced from a first position below the work surface as is shown by the solid lines in FIG. 2 to a second position proximate to the work surface (and slightly above the work surface) as is shown by the dotted lines in FIG. 2. This movement of the film gripper takes place as the drawer is moved toward its fully retracted position. In response to this movement of the drawer, the film gripper 131 is moved behind and brought upward and above the support structure s that it presents the leading edge of the film to the operator who may reach over the top of the work surface and grasp the leading edge of the film, and then complete the threading of the film in the manner as shown in FIG. 2. The means to accomplish the foregoing functions may take various forms of which the following is but the preferred example.

The film gripper 131 is comprised of pinch rollers 30 and 132 carried by the swing arms 134 which, in turn, are secured to a pivot shaft 136 to pivot from the position as shown by the solid lines in FIG. 2 to the position as shown by the dotted lines in FIG. 2 as the drawer is pushed into place to its retracted position. Each end of the pivot shaft 136 is fixed to a cam gear mechanism 300, as is shown in FIG. 6. Each cam gear mechanism 300 includes a cam wheel 302 and a gear wheel 304 which are suitably fixed to each other. The cam wheel takes the form of a circular shaped disk having a portion broken away to define a flat slide surface 306. The gear wheel 304 is provided with gear teeth 308 at its circular periphery. The flat slide surface 306 engages a flat lower surface 307 of a slide rail 309, carried by an inverted U-shaped track 400, as the drawer is displaced horizontally in the directions indicated by the arrows 312. Once the slide surface 306 slides past the end 312 of the slide rail 309, as the drawer is being pushed in toward its retracted position, the gear teeth 308 on the gear wheel 304 commence engagement with the length of a stationary gear track 320 and which may take the form of a length of bicycle chain, for example. This gear track 320 is suitably secured to track 400. Each inverted U-shaped track 400 is secured to one of the upstanding side walls 244, as by vertical extending supports 402. Each of the tracks 400 includes a downwardly extending inner track member 310 spaced from and parallel to a downwardly extending outer track member 410. These two track members are interconnected by a horizontally extending track member 412 which forms the roof (or floor) of the inverted U-shaped track.

As the drawer is being closed, the slide surface 306 slides off the lower surface 307 of the slide rail 309 at end 312 causing the gear teeth 308 to engage the stationary gear track 320. This causes the cam gear mechanism 300 to rotate in a counterclockwise direction, as viewed in FIG. 6. This causes the L-shaped swing arms 134 to pivot in the counterclockwise direction from the position as shown by the solid lines in FIG. 2 to that of the dotted lines as the drawer is pushed in to its fully retracted position.

Each end of the pivot shaft 136 extends through and is suitably journalled by a vertical support 450. One of the vertical supports 450 has its lower end suitably secured to the upstanding side wall 230 of the drawer, whereas the other vertical support 450 is suitably secured at its lower end to the other upstanding side wall 232. Consequently, as the drawer is moved in opposing directions as indicated by the arrows 312, pivot shaft 136 and the cam gear mechanisms 300 carried thereby are also displaced in the same manner resulting in the pivotal action of the swing arms 134 as discussed hereinbefore.

The film gripper 131 serves the purpose of gripping the leading edge of film 14 so that as the gripper is displaced from the position shown in solid lines in FIG. 2 to that of the dotted lines the film will be pulled from the film roll 16 and presented to an operator who may reach across the film wrapping machine to grasp the leading edge of the film from the gripper and continue to web the film wrapping apparatus in the manner shown in FIG. 2. The film gripper 31 may take various forms to accomplish the foregoing function.

In the embodiment of the invention presented herein, the film gripper takes the form of a pair of pinch rollers 130 and 132 which extend between and are journalled for rotation in the spaced apart L-shaped swing arms 134. The rollers are illustrated in greater detail in FIGS. 7 and 8 to which reference is now made. Roller 130 has a shaft 550 extending therethrough and the shaft extends beyond each end of the roller with the extended ends being journalled in circular openings, such as opening 552, in the spaced apart swing arms 134. These openings are sufficient to accommodate the shaft 550 while preventing axial dislodgement of the roller. Roller 132 overlies the film and is provided with a shaft 560 which extends through the roller and is journalled at opposite ends in elongated slots 562 provided in the swing arms 134. The slots are of sufficient length to permit movement of the roller toward and away from the film with the roller normally being spring biased toward the film by means of a suitable spring 563 which is schematically illustrated in FIG. 7. Moreover, roller 132 also carries two or more O-rings 565, of which only one is illustrated in FIG. 7, and which are mounted midway between the ends of the roller and serve to provide a level of friction gripping action as they bear against the film as it passes between rollers 130 and 132. During operation, the film is pinched between the O-rings carried by roller 132 and the roller 130.

Roller 132 is a hollow cylindrical tube which coaxially surrounds the shaft 560 and is supported thereabout by means of roller bearings 568 located at each end of the cylindrical tube with each roller bearing being press fit between the shaft 560 and the inner surface of the roller 132. Roller 132 may freely rotate about its axis in either a clockwise or counterclockwise direction, as viewed in FIG. 8.

The roller 130 also includes a tubular sleeve which coaxially surrounds shaft 550. The shaft 550 is prevented from rotating about its axis by suitable means. This, for example, may take the form of an L-shaped pin 570 having an elongated leg extending through shaft 550 and a shorter leg portion 574 extending at right angles into a suitable aperture in the swing arm 134. The roller 130 rotates about shaft 550 in a counterclockwise direction as is illustrated in FIG. 8, but is restrained from movement in a clockwise direction by means of a one-way clutch arrangement. A suitable clutch arrangement may take the form of a needle bearing one-way clutch provided by Torrington Bearing Company and known as their one-way clutch Model RCO40708. Such a one-way clutch 576 is illustrated in FIG. 7 as being press fit into one end of roller 130. The other end of the roller may be provided with a suitable roller bearing corresponding with bearing 568 on roller 132 as it has been found that a one-way clutch need only be mounted on one end of the roller. This restricts the roller 130 from rotation in a clockwise direction, as viewed in FIG. 8, to a limited extent, such as on the order of 15° of rotation.

Whereas the one-way clutch has been disclosed herein as being a needle bearing one-way clutch, it is to be appreciated that other forms of one-way clutches may be employed. For example, a ratchet and pinion mechanism may be installed on shaft 550 to interplay with the roller 130 to restrict backward movement of the roller.

Whereas the invention has been described in conjunction with a preferred embodiment, it is to be appreciated that various modifications may be made without departing from the spirit and scope of the invention as defined by the appended claims.

Having described the invention, the following is claimed:

1. Film wrapping apparatus comprising:

a work surface at which items are wrapped in film;

a support structure for supporting said work surface;

a slidable drawer assembly carried by said support structure below said work surface and including a drawer carried by said support structure for slidable horizontal movement between a drawer pulled out extended position and a drawer pushed in retracted position;

a pair of cradle rollers carried by said drawer for supporting a roll of film as said roll rotates about its axis as film is pulled from said roll;

film gripping means for gripping the leading edge of said film and for pulling said film from said roll as said gripping means is displaced from a first position below said work surface to a second position proximate to said work surface; and means for actuating said gripping means to move from said first position to said second position as said drawer is moved toward said retracted position.

2. Film wrapping apparatus as set forth in claim 1 wherein said film gripping means is carried by said drawer for horizontal slidable movement therewith.

3. Film wrapping apparatus as set forth in claim 2 wherein said actuating means includes means responsive to movement of said drawer for moving said gripping means from said first position to said second position as said drawer is moved toward said retracted position.

4. Film wrapping apparatus as set forth in claim 3 wherein said film gripping means includes a pair of pinch rollers extending transversely of said film.

5. Film wrapping apparatus as set forth in claim 4 including one-way clutch means associated with one of said pinch rollers for permitting forward movement of said film therebetween while restricting backward movement of said film toward said film roll to insure that the leading edge of said film may be gripped by said pinch rollers an pulled from said roll as said gripping means is displaced from said first position to said second position.

6. Film wrapping apparatus as set forth in claim 3 wherein said film gripping means is mounted to said drawer for movement therewith as said drawer is moved toward said retracted position.

7. Film wrapping apparatus as set forth in claim 6 including a pair of transversely spaced pivot arms each pivotally mounted to said drawer, said gripping means being carried by said pivot arms for pivotal movement therewith as said gripping means is displaced from said first position to said second position.

8. Film wrapping apparatus as set forth in claim 7 wherein said actuating means includes gear means carried by said pivot arm and gear track means mounted to said support structure for intermeshing with said gear means to rotate same causing said pivot arms to pivot to displace said gripping means from said first position to said second position as said drawer is moved toward said retracted position.

9. Film wrapping apparatus as set forth in claim 8 wherein said pivot arms are transversely spaced relative to the path of said film, said gripping means including a pair of pinch rollers extending between and carried by said pivot arms for movement therewith as said pivot arms are pivotally displaced to move said gripping means from said first position to said second position.

10. Film wrapping apparatus as set forth in claim 9 including one-way clutch means associated with at least one of said pinch rollers for permitting forward movement of said film therebetween while restricting backward movement toward said roll sufficient to insure that the leading edge of said film may be gripped by said pinch rollers and pulled from said roll as said pivot arms displace said gripping means from said first position to said second position.

* * * * *